US006906269B2

(12) United States Patent
Nishimura et al.

(10) Patent No.: US 6,906,269 B2
(45) Date of Patent: Jun. 14, 2005

(54) MULTI-DIRECTIONAL SLIDE SWITCH

(75) Inventors: Kenji Nishimura, Osaka (JP); Tamotsu Yamamoto, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/693,964

(22) Filed: Oct. 28, 2003

(65) Prior Publication Data

US 2005/0000783 A1 Jan. 6, 2005

(30) Foreign Application Priority Data

Nov. 20, 2002 (JP) ..... 2002-336423

(51) Int. Cl.[7] ..... H01H 9/00
(52) U.S. Cl. ..... 200/4; 200/16 R
(58) Field of Search ..... 200/4, 16, 16 C, 200/16 D, 16 R, 17, 18, 541, 542, 547, 549, 551

(56) References Cited

U.S. PATENT DOCUMENTS 4,475,015 A * 10/1984 Kobayashi et al. ..... 200/5 R
4,525,607 A * 6/1985 Senoh ..... 200/16 R
5,153,401 A * 10/1992 Tseng ..... 200/550
5,327,162 A * 7/1994 Soma ..... 345/161
5,735,391 A * 4/1998 Harrell et al. ..... 200/549
5,901,839 A * 5/1999 Sasaki et al. ..... 200/551
6,479,776 B2 * 11/2002 Nakase et al. ..... 200/559
6,608,263 B2 * 8/2003 Myojin ..... 200/16 D
6,689,967 B2 * 2/2004 Myojin ..... 200/18

FOREIGN PATENT DOCUMENTS

JP 2001-307599 11/2001

* cited by examiner

*Primary Examiner*—Lincoln Donovan
*Assistant Examiner*—M. Fishman
(74) *Attorney, Agent, or Firm*—Wenderoth, Lind & Ponack, L.L.P.

(57) ABSTRACT

When a control lever is slid to move a driver housed in a quadrangular case in a given direction, the movement of the driver allows the driver to push one of resilient legs of movable contacts corresponding to the direction of movement. This movement resiliently slides the corresponding movable contact along an inner surface of the sidewall of the case and brings the movable contact into contact with a corresponding fixed contact. This structure can provide a multi-directional slide switch of low profile that has a small number of members and is easily assembled.

13 Claims, 12 Drawing Sheets

MULTI-DIRECTIONAL SLIDE SWITCH

BACKGROUND OF THE INVENTION

1. Field of the Invention

The present invention relates to a multi-directional slide switch for input operation of various kinds of electronic equipment in which the sliding operation of a control lever scrolls a display on a screen.

2. Background Art

A conventional slide switch disclosed in the Japanese Patent Unexamined Publication No. 2001-307599 is described with reference to FIGS. 10 through 16.

FIG. 10 is an elevational view in section of the conventional multi-directional slide switch. FIG. 11 is an exploded perspective view thereof. FIG. 12 is a plan view of a case thereof. FIG. 13 is a plan view of a section thereof, illustrating how a first slide member is assembled. FIG. 14 is a plan view of another section thereof, illustrating how a second slide member is assembled.

As shown in FIG. 12, in box-shaped case 1 made of a resin, four fixed contacts (hereinafter referred to as "contacts") 2A through 2D and four ground patterns 2E are disposed on the quadrangular inner bottom surface of case 1 along corresponding sidewalls thereof. As shown in FIGS. 10 and 11, first slide member (hereinafter referred to as a "slide member") 3 and second slide member (hereinafter referred to as a "slide member") 4 are stacked and housed in case 1. While slide member 3 is guided to slide in an X-axis direction parallel to the opposed sidewalls, slide member 4 is guided to slide in a Y-axis direction parallel to the other opposed sidewalls. The top opening of case 1 is covered with cover 5. On the top surface of slide member 3, control lever 6 (hereinafter referred to as a "lever") is provided to project upwardly from penetration-hole 5A through cover 5. Attached to the bottom surface of slide member 3, movable contact (hereinafter referred to as a "contact") 7 is formed of a resilient thin metal plate. Provided in the center of slide member 4 is through-hole 4A into which lever 6 is fitted with play.

As shown FIGS. 11 and 13, a pair of first engaging parts (hereinafter referred to as "engaging parts") 3A on the top surface of slide member 3 are engaged with a pair of first guide parts (hereinafter referred to as "guide parts") 4B that are provided on the bottom surface of slide member 4 to have a length equal to that of engaging parts 3A. Similarly, as shown FIGS. 11 and 14, a pair of second engaging parts (hereinafter referred to as "engaging parts") 4C on the top surface of slide member 4 are engaged with a pair of second guide parts (hereinafter referred to as "guide parts") 5B that are provided on the bottom surface of cover 5 to have a length equal to that of engaging parts 4C. These structures allow slide member 3 and slide member 4 to be guided so that they slide in the X-axis direction and Y-axis direction, respectively.

In the vicinity of both ends of guide parts 4B, a pair of first return springs (hereinafter referred to as "springs") 8 are disposed. Similarly, in the vicinity of both ends of guide parts 5B, a pair of second return springs (hereinafter referred to as "springs") 9 are disposed. The pair of springs 8 are opposed so that respective coil portions 8A are positioned by a pair of opposed projections 4D. Similarly, the pair of springs 9 are opposed so that respective coil portions 9A are positioned by a pair of opposed projections 5C. In an inoperative state, arm portions 8B of springs 8 are adopted to make contact with guide parts 4B and ends of engaging parts 3A. On the other hand, arm portions 9B of springs 9 are adopted to make contact with guide parts 5B and ends of engaging parts 4C. This structure keeps engaging parts 3A and 4C, i.e., slide members 3 and 4, at rest in a neutral position.

Contact 7 is attached to the bottom surface of slide member 3. In an inoperative state, the tips of four resilient legs 7A through 7D are adopted to make contact with the inner bottom surface of case 1 between corresponding contacts 2A through 2D and corresponding four ground patterns 2E, as shown by the two-dot chain lines in FIG. 12.

As for press switch section 10 disposed in the center of the inner bottom surface of case 1, depressing press rod 11 disposed through the center portion of lever 6 resiliently deforms dome-shaped movable contact 12 for actuation.

First, in the conventional multi-directional slide switch structured as above, a description is provided of a case where lever 6 is pushed rightward from the inoperative state shown in FIG. 13 for a sliding operation in the X-axis direction.

As shown in FIG. 15, the ends on one side of engaging parts 3 push arm portions 8B of corresponding spring 8 on the right side. This resiliently deforms coil portion 8A while slide member 3 moves in the X-axis direction. Accordingly, the tip of resilient leg 7A of contact 7 shown FIG. 12 is brought into contact with contact 2A, and the tip of resilient leg 7B is brought into contact with ground pattern 2E. A signal is transferred to the outside from the terminals on the outer periphery of case 1. Thereafter, when the pushing force applied to lever 6 is removed, the resilient restoring force of spring 8 pushes engaging parts 3A, i.e., slide member 3, back to the original state shown in FIG. 13.

Next, a description is provided of a case where lever 6 is pushed backward from the inoperative state shown in FIG. 14 for a sliding operation in the Y-axis direction. As shown in FIG. 16, while engaging parts 4C resiliently deform corresponding spring 9 on the backward side, slide member 4 moves in the Y-axis direction. Accordingly, the tip of resilient leg 7C is brought into contact with contact 2C and the tip of resilient leg 7D is brought into contact with ground pattern 2E.

However, having a large number of components and taking much assembling time, this conventional multi-directional slide switch is expensive. Additionally, because slide members 3 and 4 are stacked, the switch has a high profile.

SUMMARY OF THE INVENTION

A multi-directional switch of the present invention includes a case, movable contacts, and a driver. The case has fixed contacts on the inner surfaces of sidewalls standing erect from the outer periphery of the bottom surface thereof or on the bottom surface in the vicinity of the sidewalls. The movable contacts are disposed in the case. The movement of the movable contacts toward the center of the case is restricted. The movable contacts are disposed so that one end thereof is in contact with one of the fixed contacts. The driver is movably housed in the case. In an inoperative state, the movable contacts urge and place the driver in the center of the case. Sliding the driver causes the driver to push and bring one of the movable contacts into contact with one of the fixed contacts.

DETAILED DESCRIPTION OF THE INVENTION

Exemplary embodiments of the present invention are described hereinafter with reference to the accompanying drawings. In the description, like constituent components are denoted with the same reference marks and detailed description of these components are omitted.

First Exemplary Embodiment

Figure 1:
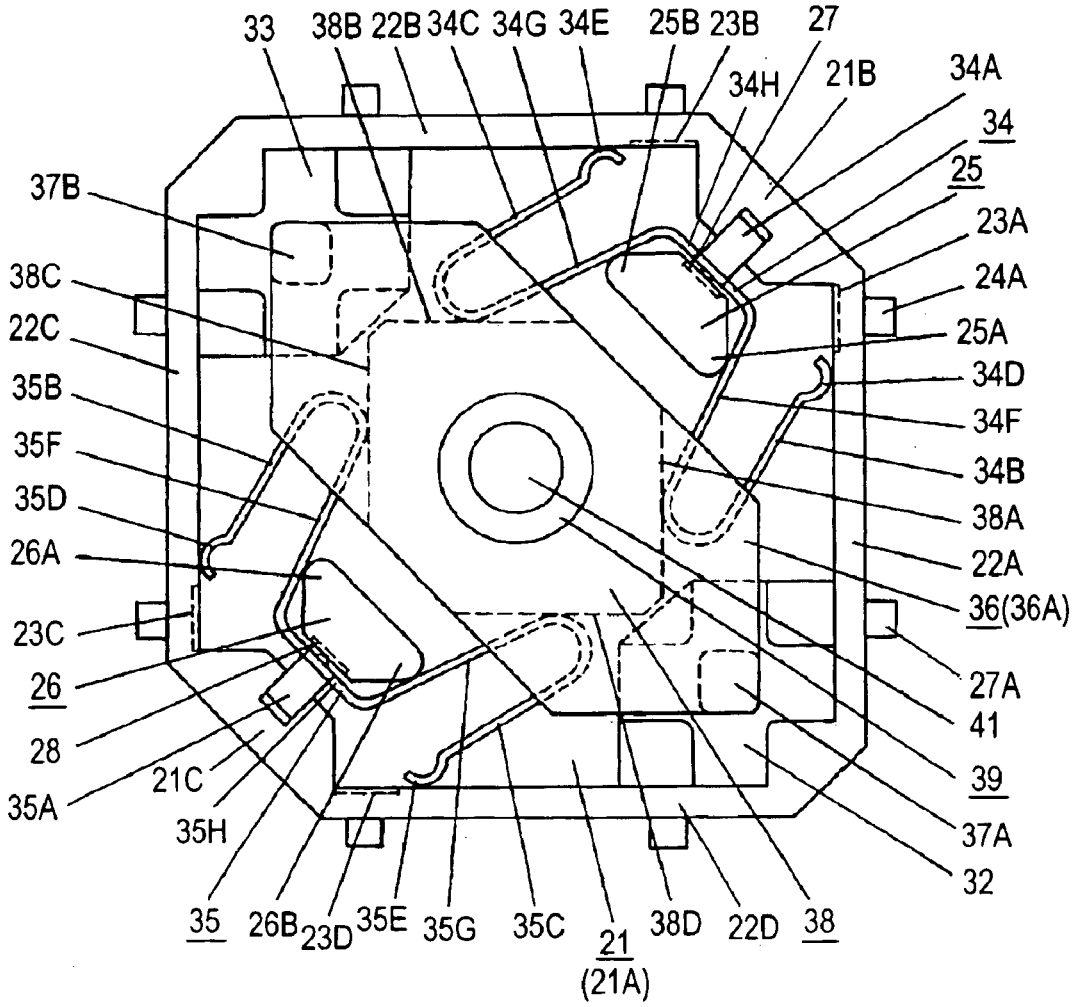
FIG. 1 is a plan view of a multi-directional slide switch in accordance with a first exemplary embodiment of the present invention, with a cover thereof removed.
Figure 2:
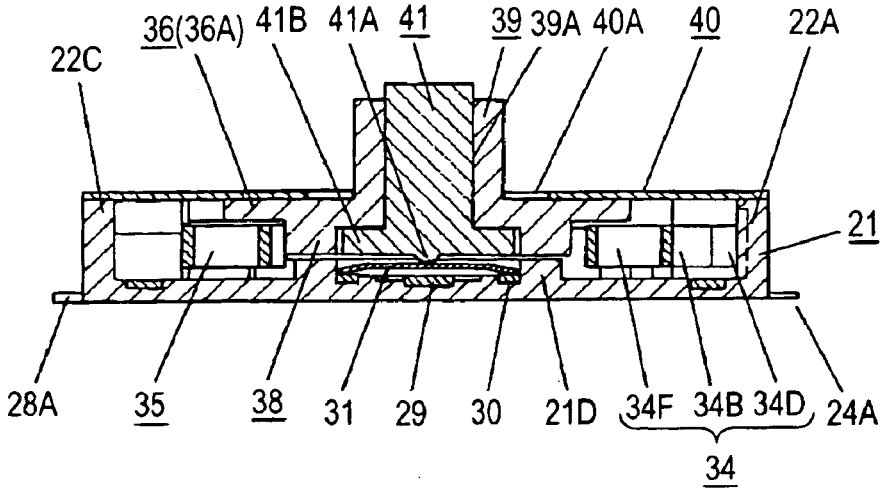
FIG. 2 is an elevational view in section of the multi-directional slide switch of FIG. 1.
Figure 3:
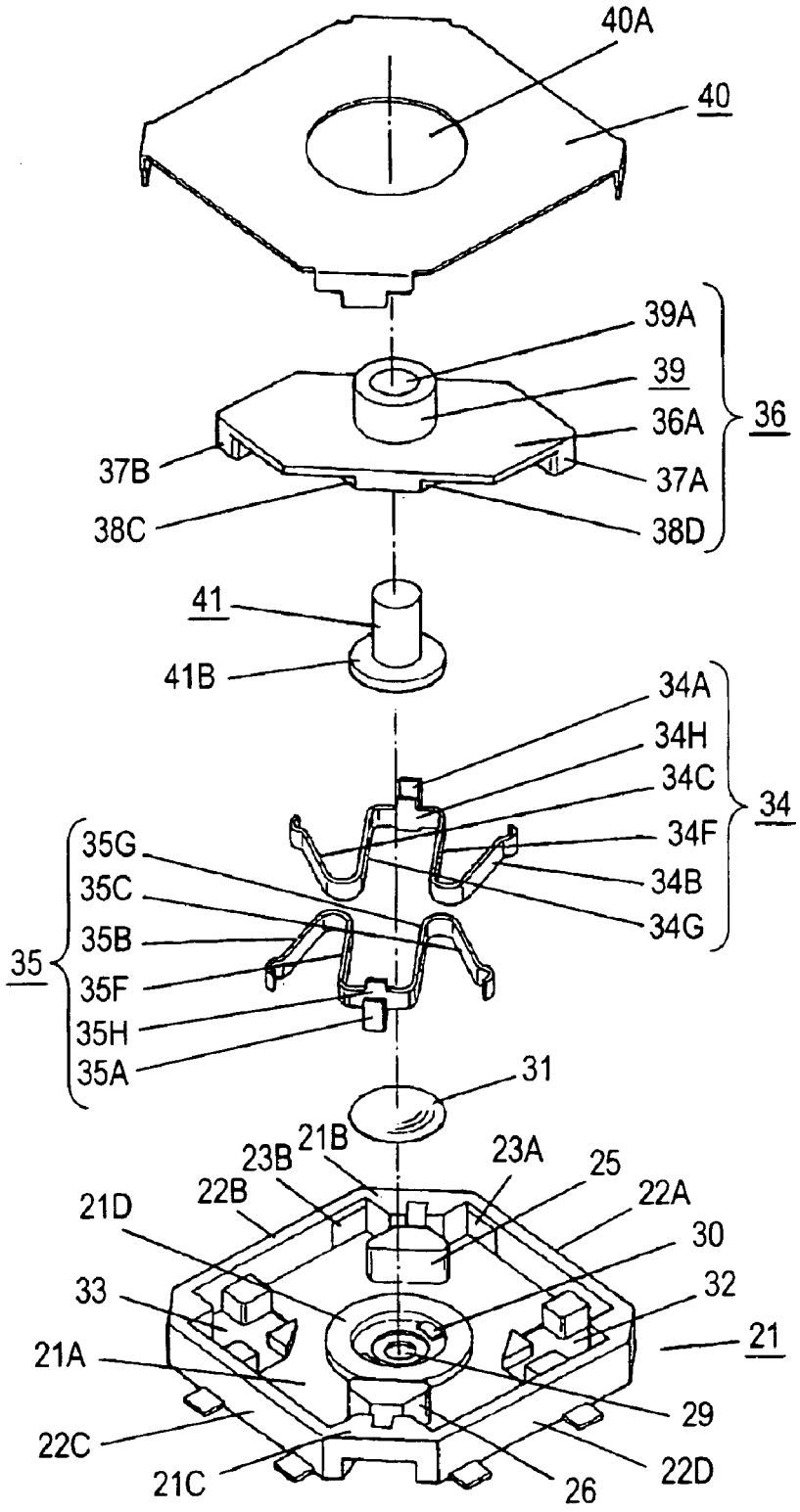
FIG. 3 is an exploded perspective view of the multi-directional slide switch of FIG. 1.
Figure 4:
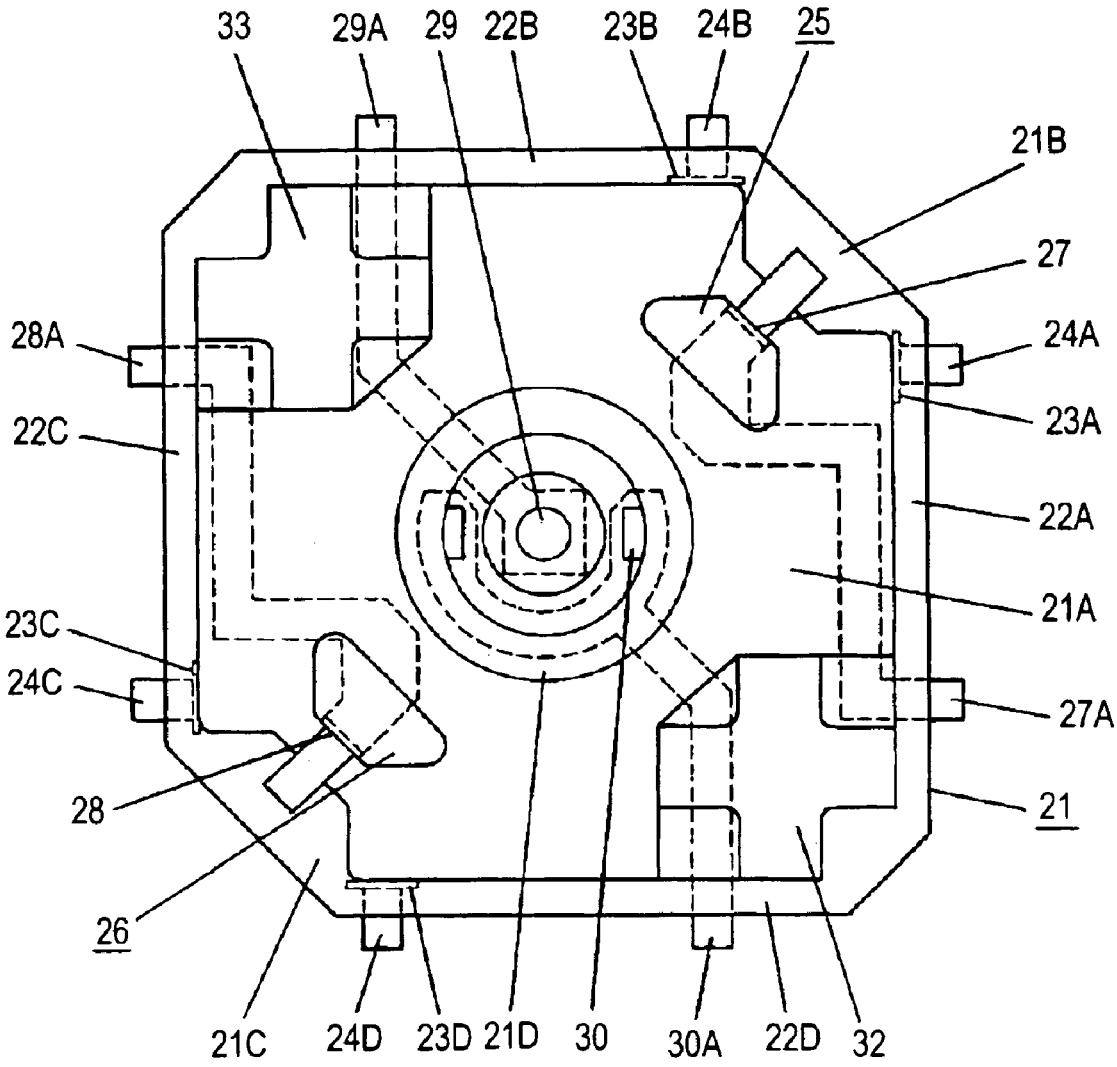
FIG. 4 is a plan view of a case of the multi-directional slide switch of FIG. 1.

FIG. 1 is a plan view of a multi-directional slide switch in accordance with a first exemplary embodiment of the present invention, with a cover thereof removed. FIG. 2 is an elevational view in section thereof. FIG. 3 is an exploded perspective view thereof. FIG. 4 is a plan view of a case thereof.

Box-shaped case 21 has four sidewalls 22A through 22D standing erect from the outer peripheral four sides of quadrangular bottom surface 21A, as shown in FIG. 3 and 4. Case 21 is made of an insulating material. An insulating ceramic material can be used. However, in order to form the complicated interior shape at low cost, resin is preferable. On the inner surfaces of sidewalls 22A through 22D, corresponding fixed contacts (hereinafter referred to as "contacts") 23A through 23D each shaped like a flat plate are disposed so as to be exposed in positions symmetrical with respect to the center of bottom surface 21A. Terminals 24A through 24D electrically connected with corresponding contacts 23A through 23D project from the outer peripheries of corresponding sidewalls 22A through 22D.

Supports 25 and 26, each having a trapezoidal shape as seen from the top, project from bottom surface 21A, in positions on one of diagonal lines passing between contact 23A and contact 23B. This diagonal line also passes between contact 23C and contact 23D. On the side faces of supports 25 and 26 opposed to corners 21B and 21C, respectively, connection contacts (hereinafter referred to as "contacts") 27 and 28 are provided. Terminals 27A and 28A electrically connected with corresponding contacts 27 and 28 project form the outer peripheries of corresponding sidewalls 22A and 22C.

These contacts 23A through 23D, 27 and 28, terminals 24A through 24D, 27A and 28A, and movable contacts 34 and 35, which will be described later, constitute a slide switch section.

On the other hand, provided inside of circular wall 21D surrounding the center of bottom surface 21A are fixed contacts for a press switch section, made of center contact 29 and a pair of side contacts 30 sandwiching center contact 29. Terminals 29A and 30A electrically connected with corresponding contacts 29 and 30 project from the outer peripheries of corresponding sidewalls 22B and 22D. As shown in FIG. 2, disposed on fixed contacts 29 and 30 for this press switch section is dome-shaped movable contact (hereinafter referred to as a "contact") 31 made by drawing a resilient metal thin plate into a bowl shape. The bottom end of the outer periphery of contact 31 is mounted on side contacts 30. The bottom surface of the top portion of contact 31 is opposed to center contact 29 with a predetermined space provided therebetween. Thus, the press switch section is constructed.

Additionally, as shown in FIG. 4, guide parts 32 and 33 are provided at the other corners of case bottom surface 21A. Each of guide parts 32 and 33 has a cross-shaped recess extending in directions parallel to opposed sidewalls 22A and 22C, and opposed sidewalls 22B and 22D. The structure of guide parts 32 and 33 is not limited to the above-mentioned cross-shaped recess formed in bottom surface 21A of case 21. The cross-shaped outline can at least be formed by providing projections on sidewalls 22A, 22B, 22C, and 22D.

Movable contacts (hereinafter referred as "contacts") 34 and 35 are made by forming a resilient thin metal plate having a predetermined width into substantially an M shape, as shown in FIG. 3. It is easy to form contacts 34 and 35 by bending. However, another method can be used. As shown in FIG. 1, connection leg 34A in center portion 34H of the M shape is fitted between contact 27 on support 25 and corner 21B, fixed thereto, and electrically connected with contact 27. Similarly, connection leg 35A is fitted between contact 28 on support 26 and corner 21C, fixed thereto, and electrically connected with contact 28. In other words, center portions 34H and 35H function as the portions for fixing contacts 34 and 35, respectively. Because of this structure, supports 25 and 26 inhibit corresponding contacts 34 and 35 from moving toward the center of case 21.

Tips 34D and 34E of resilient legs 34B and 34C at both ends of M-shaped contact 34 are adopted to make contact with the vicinities of contacts 23A and 23B on sidewalls 22A and 22B of case 21, respectively, so that a predetermined space is provided between the vicinity and each fixed contact. Similarly, tips 35D and 35E of resilient legs 35B and 35C at both ends of M-shaped contact 35 are adopted to make contact with the vicinities of contacts 23C and 23D on sidewalls 22C and 22D of case 21, respectively, so that a predetermined space is provided between the vicinity and each fixed contact.

Additionally, two resilient arms 34F and 34G for connecting center portion 34H and the roots of corresponding resilient legs 34B and 34C of contact 34 are adopted to make contact with corresponding symmetrical corners 25A and 25B of support 25, in the middle portions of the resilient arms. Resilient arms 34F and 34G are supported and restricted in positions symmetrical with respect to the diagonal line connecting corners 21B and 21C of case 21. Similarly, two resilient arms 35F and 35G for connecting center portion 35H and the roots of corresponding resilient legs 35B and 35C of contact 35 are adopted to make contact with corresponding symmetrical corners 26A and 26B of support 26, in the middle portions of the resilient arms. Resilient arms 35F and 35G are supported and restricted in positions symmetrical with respect to the center of case bottom surface 21. Because of this structure, one movable contact 34 forms two switches.

As shown by the dotted lines in FIG. 1, driver 36 has columns 37A and 37B on the bottom surfaces of protrusions symmetrical with respect to the center of driver 36, at both ends of body portion 36A shaped like a long plate. Like case 21, driver 36 is also formed of ceramic material or resin. Columns 37A and 37B are respectively positioned at the center of cross-shaped guide parts 32 and 33 on bottom surface 21A. This structure allows columns 37A and 37B to make a predetermined amount of linear movement in the direction parallel to opposed sidewalls 22A and 22C and in the direction parallel to opposed sidewalls 22B and 22D. Columns 37A and 37B provided on driver 36 serve as portions for restricting driver 36.

Square portion 38 protruding downwardly from body portion 36A has four side-face contact portions (hereinafter referred to as "contact portions") 38A through 38D. Contact portions 38A through 38D are in contact with the corresponding vicinities of portions for connecting resilient legs and arms, i.e., the tips of resilient arms 34F, 34G, 35F, and 35G of contacts 34 and 35. This structure keeps square portion 38 in the neutral position in case 21.

As shown in FIGS. 2 and 3, control lever (hereinafter referred to as a "lever") 39 is integrally formed with body portion 36A in the center of the top surface thereof. Lever 39 projects outwardly from hole 40A in the center of cover 40 that is joined to case 21 to cover the upper opening of case 21. This structure facilitates the operation of driver 36.

Further, press rod 41 for driving the press switch section is disposed through through-hole 39A in the center of lever 39 so as to be movable vertically. Bottom end projection 41A of press rod 41 is in contact with the top surface of the top portion of contact 31 in the press switch section. At the bottom end of press rod 41, large-diameter flange 41B is provided. Bottom end projection 41A is provided on the bottom surface of flange 41B.

The multi-directional slide switch of this embodiment is structured as above. Next, the operation thereof is described.

First, the operation of the slide switch section is described. In an inoperative state as shown in FIG. 1, tips 34D, 34E, 35D, and 35E of corresponding resilient legs 34B, 34C, 35B and 35C are out of contact with corresponding contacts 23A through 23D. In other words, the switch is in the off-state.

Figure 5:
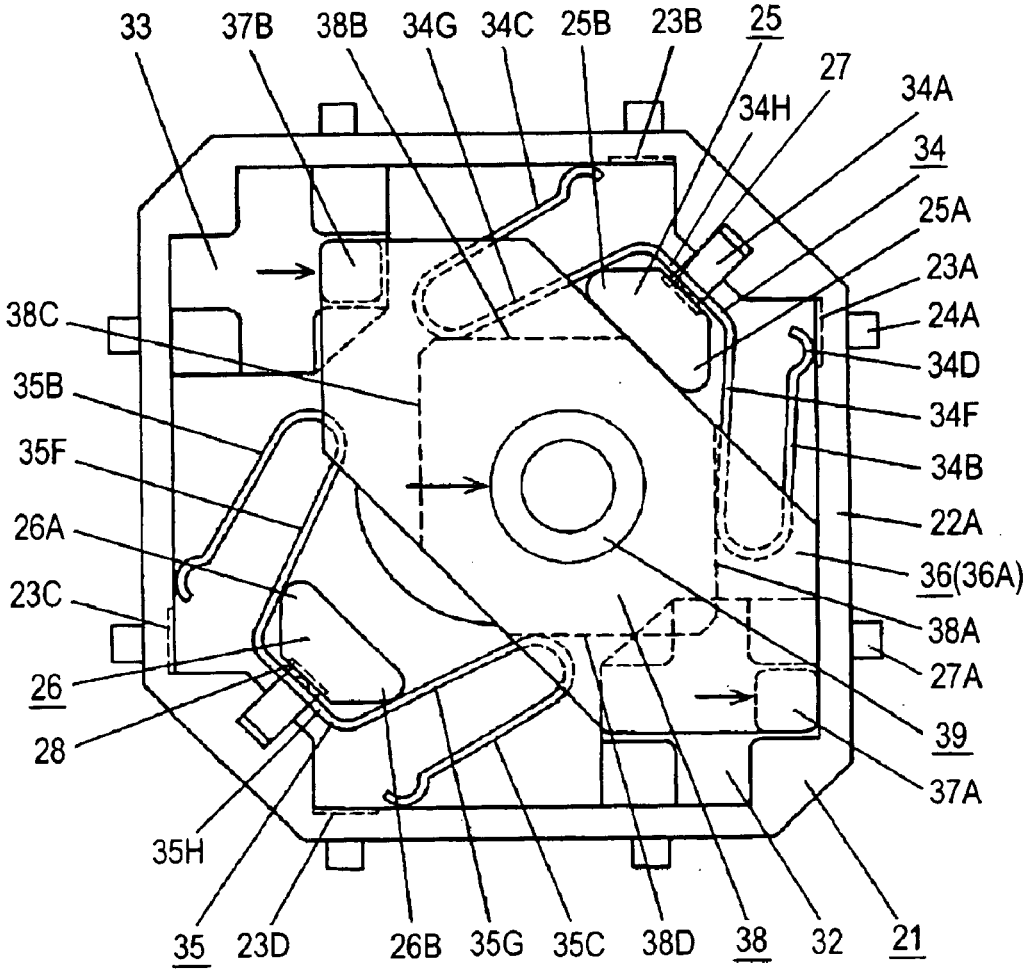
FIG. 5 is a plan view of the multi-directional slide switch of FIG. 1 in sliding operation, with the cover removed.

When force is applied to slide lever 39 in the rightward direction in this state, as shown by the arrow in FIG. 5, entire driver 36 moves rightward. At this time, columns 37A and 37B of driver 36 are guided to the right sides of the recesses in guide parts 32 and 33, respectively. Contact portion 38C of driver 36 leaves resilient arm 35F of contact 35. Contact portion 38B moves rightward while it is in contact with the vicinity of the portion connecting resilient arm 34G and resilient leg 34C of contact 34. Similarly, contact portion 38D moves rightward while it is in contact with the vicinity of the portion connecting resilient arm 35G and resilient leg 35C of contact 35.

Then, contact portion 38A pushes the tip of resilient arm 34F of contact 34 in contact with contact portion 38A, in the rightward direction. Pushed resilient arm 34F pivots around the fulcrum at connection leg 34A, i.e., a fixation portion at the root of resilient arm 34F. The middle portion of resilient arm 34F leaves corner 25A of support 25 on case 21. Additionally, because the root of resilient leg 34B approaches sidewall 22A of case 21, tip 34D is slid on the inner surface of sidewall 22A and adopted to make contact therewith, and brought into contact with contact 23A. This action establishes electrical connection between contacts 27 and 23A, i.e., terminals 27A and 24A, via contact 34. This signal is transferred to the outside. In this manner, this switch is structured so that contact 34 has center portion 34H, resilient legs 34B and 34C, and resilient arms 34F and 34G, and center portion 34H is fixed to a position on one of diagonal lines of the case inner bottom surface. This structure makes such an action possible.

At this time, resilient arm 34G of contact 34 is adopted to make contact with corner 25B of support 25 on case 21 and does not move. Similarly, resilient arms 35F and 35G are adopted to make contact with corresponding corners 26A and 26B of support 26 on case 21 and do not move. Providing supports 25 and 26 of this structure prevents the malfunction of the contacts.

Thereafter, when the force applied to lever 39 is removed, resilient restoring force of contact 34 causes resilient arm 34F to push driver 36 toward the center of case 21 along contact portion 38A. Thus, while columns 37A and 37B are guided by guide parts 32 and 33, the switch returns to the original inoperative state as shown in FIG. 1. In other words, the switch returns to a stable neutral state in which driver 36 is urged toward the center from outer peripheral four directions by contacts 34 and 35. At this time, tip 34D of resilient leg 34B of contact 34 leaves contact 23A. This action is realized by providing resilient arm 34F in movable contact 34 and providing contact portion 38A in driver 36.

In a similar manner, pushing lever 39 leftward from the inoperative state shown in FIG. 1 establishes electrical contact between contacts 28 and 23C. Likewise, pushing lever 39 backward establishes electrical contact between contacts 27 and 23B and pushing lever 39 forward establishes electrical contact between contacts 28 and 23D. In other words, lever 39 is pushed in a direction parallel to bottom surface 21A of case 21 so as to be slid in one of four directions parallel to sidewalls 22A through 22D. Then, entire driver 36 translates along guide parts, and one of the contact portions of driver 36 corresponding to the sliding direction pushes the vicinity of the connecting portion of the resilient arm of the movable contact in contact with the contact portion. This causes the tip of the resilient leg to slide on the inner surface of the sidewall of the case in contact with the tip and to make contact with a corresponding fixed contact. Thus, a given signal is obtained.

As described above, in this embodiment, the movement of columns 37A and 37B, i.e., simply structured restricting portions for driver 36, is restricted by guide parts 32 and 33. This structure restricts the sliding operation to four directions, i.e., right left, front and back, only. In other words, the restricting portions restrict the directions of movement of driver 36 in operation using a simple structure. Thus, driver 36 is operated in the sliding directions preset by the restricting portions only. Additionally, in this embodiment, forming guide parts 32 and 33 as recesses also restrict unnecessary movement of driver 36. Further, in this multi-directional slide switch, contacts are disposed so as to provide a given signal when the switch is operated in one of these directions.

The multi-directional slide switch of this embodiment has a small number of components. Thus, the switch is easily assembled and has a low profile. Especially, each movable contact is structured as substantially an M shape. Each movable contact is supported from the inside so that a pair of resilient arms are placed symmetrically with respect to the diagonal line of bottom surface 21A, and forms two switches. This structure reduces the number of components. Further, because two of such a substantially M-shaped movable contact are disposed in positions symmetrical with respect to the center of bottom surface 21A, a four-directional switch of a simple structure is realized.

In the above description, each of movable contacts 34 and 35 is formed by bending a resilient thin metal plate to substantially an M shape. Resilient arms 34F and 34G are integrally formed with resilient legs 34B and 34C, respectively, so that they are symmetrical with respect to the centerline going through the center portions 34H of the M shapes, i.e., fixation portions. Similarly, resilient arms 35F and 35G are integrally formed with resilient legs 35B and 35C, so that they are symmetrical with respect to the centerline going through the center portions 35H. This structure allows each of contacts 23A through 23D to form an electrically independent switch. Instead of this structure, each of the movable contacts can be divided into two pieces in the center portion of the M shape, and the divided pieces can be fixed to corners 21B and 21C of case 21.

In the description of this embodiment, guide parts each having a cross-shaped recess are provided in a case having a quadrangular bottom surface, and a driver is movable in four directions parallel to the sides of the case, i.e., front, back, right, and left. However, the shape of the case bottom surface and directions of movement of the driver are not limited to the above description. The shape can be pentagonal, hexagonal, or circular. For example, the case bottom can be shaped hexagonal so that a driver is movable in six directions parallel to the respective sides. In this case, the shape of the movable contact includes the above-mentioned substantially M shape divided into two pieces, and mixture of substantially the M shape and divided pieces.

As the shape of the case bottom surface, regular polygons are preferable. In this case, movable contacts can be formed into the same size and thus components can be shared. When a case bottom surface is shaped like a polygon, the center portion of each movable contact is fixed to a position on a line connecting a given point on the case bottom surface and a corresponding corner. When a case bottom surface is shaped like a regular polygon, the center portion of each movable contact is fixed to a position on a line connecting the center of the polygon and a corresponding corner. This makes the spaces between disposed movable contacts equal and thus the movable contacts of the same shape can easily be installed.

In the above description, when lateral pushing force is applied to slide lever 39, tips 34D and 34E of contact 34 are adopted to make contact with and slid on the inner surfaces of sidewalls 22A and 22B, respectively, in the direction as to approach the center portion 34H. Similarly, tips 35D and 35E of contact 35 are adopted to make contact with and slid on the inner surfaces of sidewalls 22C and 22D, respectively, in the direction as to approach the center portion 35H. However, the direction of each of resilient legs 34B, 34C, 35B, and 35C can be changed so that the resilient leg leaves the center portion of the M shape.

In the above description, the slide switch section is in the off-state in its inoperative state and electrical connection is established between given terminals by a sliding operation. However, it is also possible that the switch is in the on-state in its inoperative state and electrical connection between given terminals is broken off by the sliding operation.

In the above description, contacts 23A through 23D are disposed on the inner surfaces of sidewalls 22A through 22D, respectively, which stand erect from the outer peripheral four sides of bottom surface 21A of case 21. However, contacts 23A through 23D can be provided on bottom surface 21A in the vicinity of sidewalls 22A through 22D, respectively, so that the tips of resilient legs 34B, 34C, 35B, and 35C of contacts 34 and 35 are brought into contact with corresponding contacts 23A through 23D.

Next, the operation of the press switch section is described. In an inoperative state shown in FIG. 2, the press switch section is in the off-state. In other words, electrical connection is not established between terminals 29A and 30A shown in FIG. 4.

Figure 6:
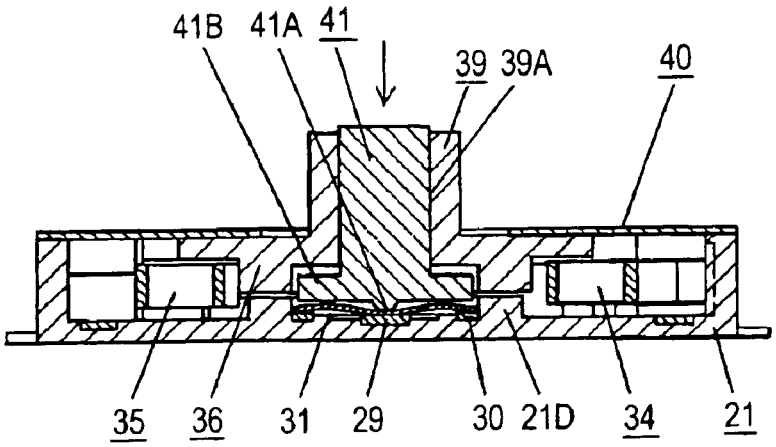
FIG. 6 is an elevational view in section of the multi-directional slide switch of FIG. 1 in depressing operation.

In this state, as shown by the arrow in FIG. 6, downward force is applied to press rod 41 disposed in the center of lever 39, for a depressing operation. Then, bottom end projection 41A on press rod 41 depresses and resiliently deforms the top portion of contact 31, thereby bringing the bottom surface of the top portion into contact with center contact 29. This establishes electrical contact between center contact 29 and side contacts 30, i.e., terminal 29A and terminal 30A in FIG. 4 are electrically connected via contact 31. The signal is transferred to the outside. Thereafter, when the force applied to press rod 41 is removed, resilient restoring force of contact 31 pushes back press rod 41 upwardly, thereby restoring the switch to its original state shown in FIG. 2. In other words, the bottom surface of the top portion of contact 31 leaves center contact 29.

As described above, in this embodiment, in addition to a signal obtained by sliding operation of lever 39, another signal can be obtained by depressing operation of press rod 41. However, the press switch section is not necessarily required and a multi-directional slide switch can be structured of a slide switch section only. In this embodiment, guide parts 32 and 33 are provided at the corners of case bottom surface 21A. When the press switch section is not incorporated, the guide parts can be provided in the center of case bottom surface 21A. In this case, the restricting portions are provided in the center of the bottom surface of body portion 36A.

This press switch section is structured to be operable only when driver 36 is in an inoperative position. Next, this structure is described.

As shown in FIGS. 2 and 3, large-diameter flange 41B is provided at the bottom end of press rod 41, and bottom end projection 41A is formed to project at the center of flange 41B. As shown in FIG. 2, flange 41B is positioned above the top end of circular wall 21D that is provided on bottom surface 21A of case 21 to surround the press switch section. Specifically, flange 41B is positioned above circular wall 21D by a dimension smaller than the operative stroke of the press switch section. Additionally, the clearance between the outer diameter of flange 41B and the inner diameter of circular wall 21D is set smaller than the amount of movement of lever 39, i.e., press rod 41, in sliding operation.

Figure 7:
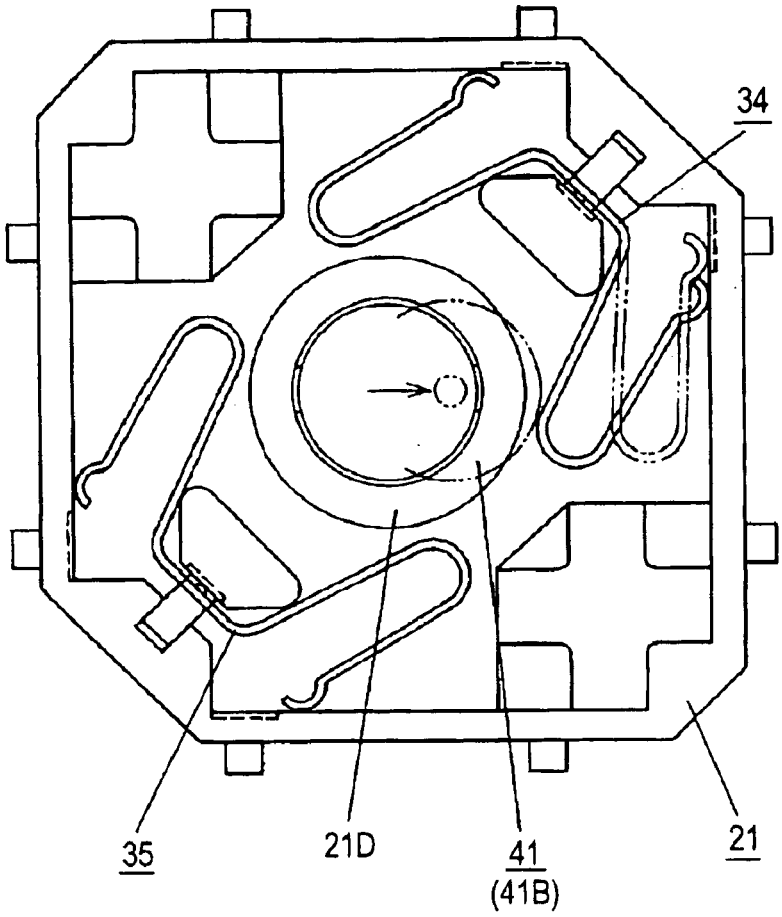
FIG. 7 is a plan view of the multi-directional slide switch of FIG. 5, with the cover and a driver thereof removed.

When lever 39 is slid, press rod 41 moves laterally with lever 39. Therefore, when lever 39 is slid, a part of flange 41B overlaps the top end of circular wall 21D, as shown by the two-dot chain lines in FIG. 7. In this state, press rod 41 can move downwardly by the difference between the bottom end of flange 41B and the top end of circular wall 21D only. In other words, while lever 39 is slid, the press switch section is inoperable. This structure prevents malfunction of the press switch section during the sliding operation. Flange 41B also serves to prevent press rod 41 from falling out of through-hole 39A through lever 39.

Second Exemplary Embodiment

Figure 8:
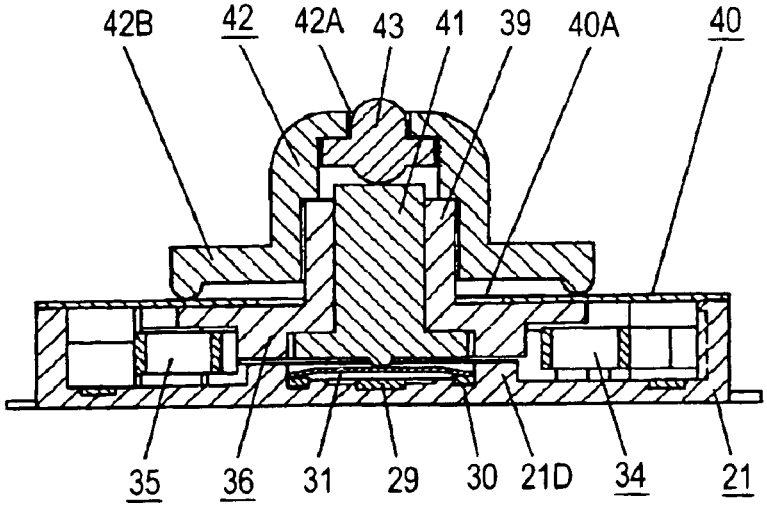
FIG. 8 is an elevational view in section of a multi-directional slide switch in accordance with a second exemplary embodiment of the present invention.

FIG. 8 is an elevational view in section of a multi-directional slide switch in accordance with a second exemplary embodiment of the present invention. In this embodiment, knob 42 is attached to the structure of the first exemplary embodiment. The structure of the other components is the same as that of the first exemplary embodiment.

Over the tip of control lever 39, control knob 42 is fitted. In through-hole 42A in the center of knob 42, push button 43 is inserted to be independently and vertically movable. The bottom end of knob 42 forms large-diameter portion 42B. The outer peripheral bottom end of large-diameter portion 42B is in contact with the outer peripheral plane around hole 40A through cover 40 for covering the top opening of case 21.

Structuring knob 42 in this manner prevents jerky movements of driver 36 caused by the tilt thereof and provides smooth operation when lateral pushing force is applied to slide knob 42. Additionally, covering hole 40A through cover 40 provides good appearance and improves dust resistance. Further, depressing push button 43 can actuate a press switch section.

Third Exemplary Embodiment

Figure 9:
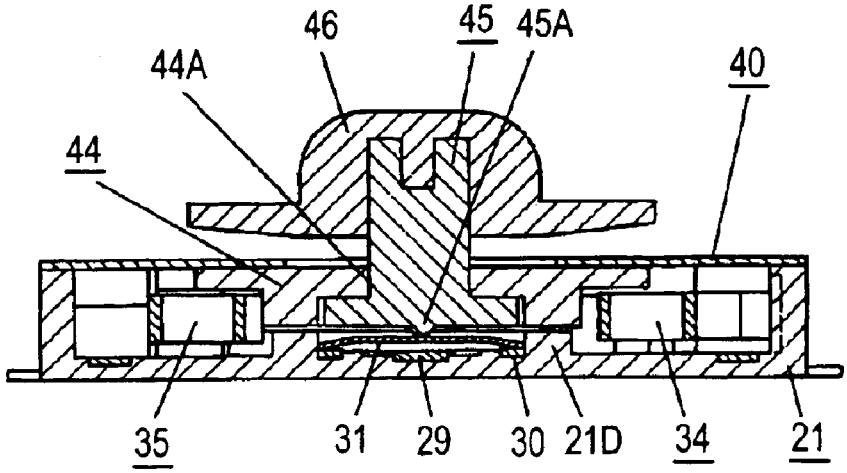
FIG. 9 is an elevational view in section of a multi-directional slide switch in accordance with a third exemplary embodiment of the present invention.
Figure 10:
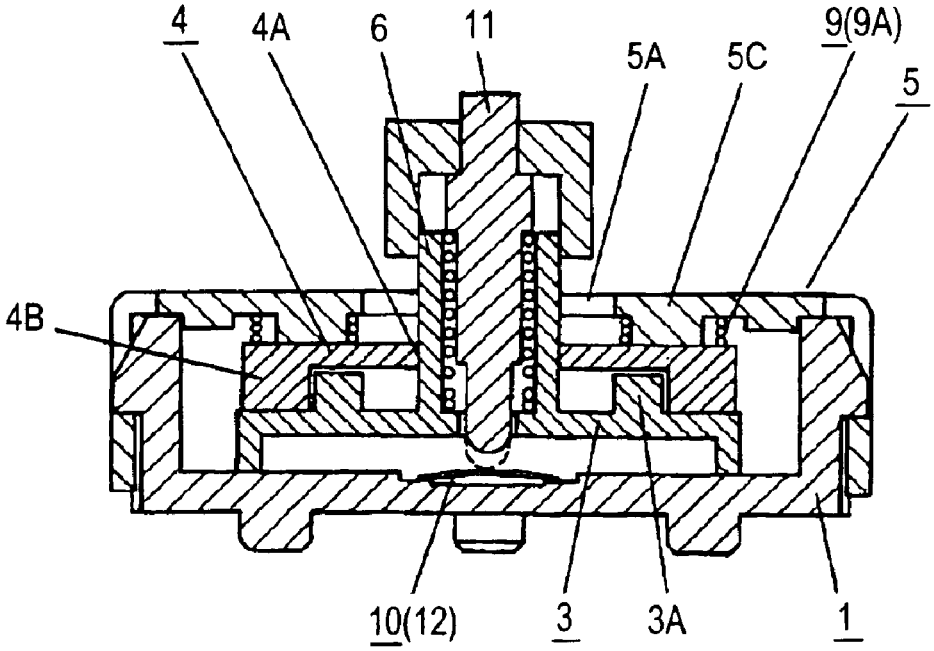
FIG. 10 PRIOR ART
FIG. 10 is an elevational view in section of a conventional multi-directional slide switch.
Figure 11:
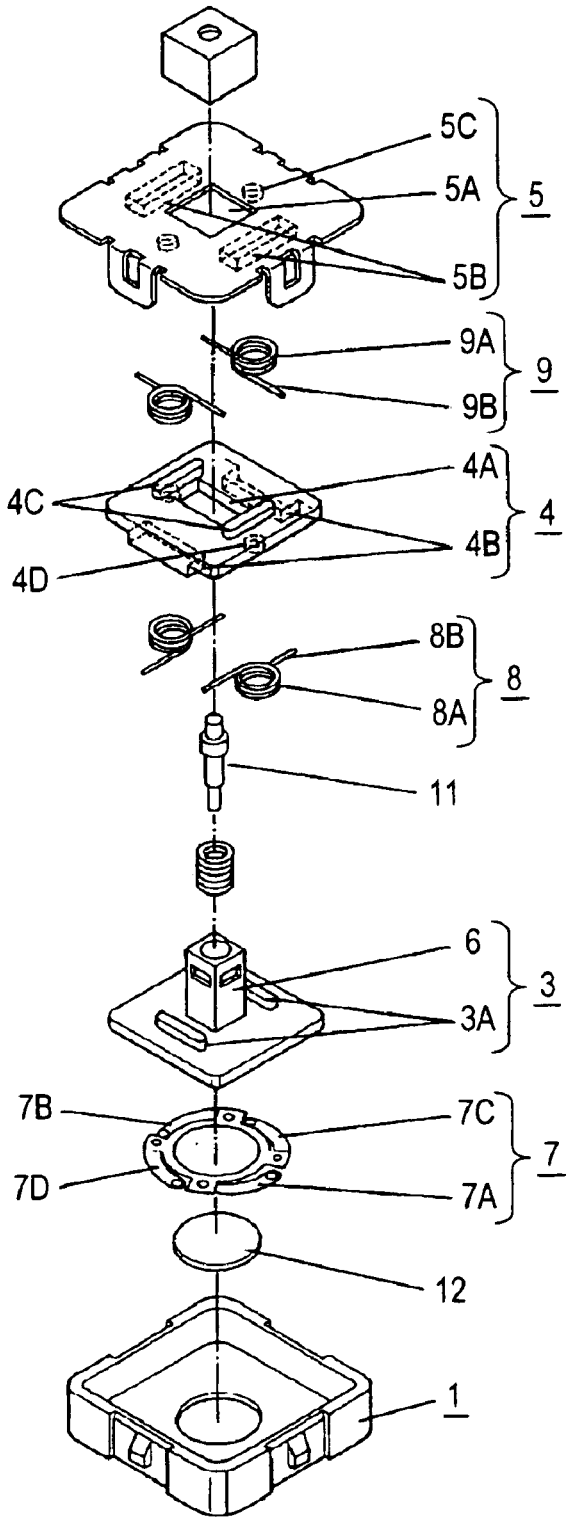
FIG. 11 PRIOR ART
FIG. 11 is an exploded perspective view of the multi-directional slide switch of FIG. 10.
Figure 12:
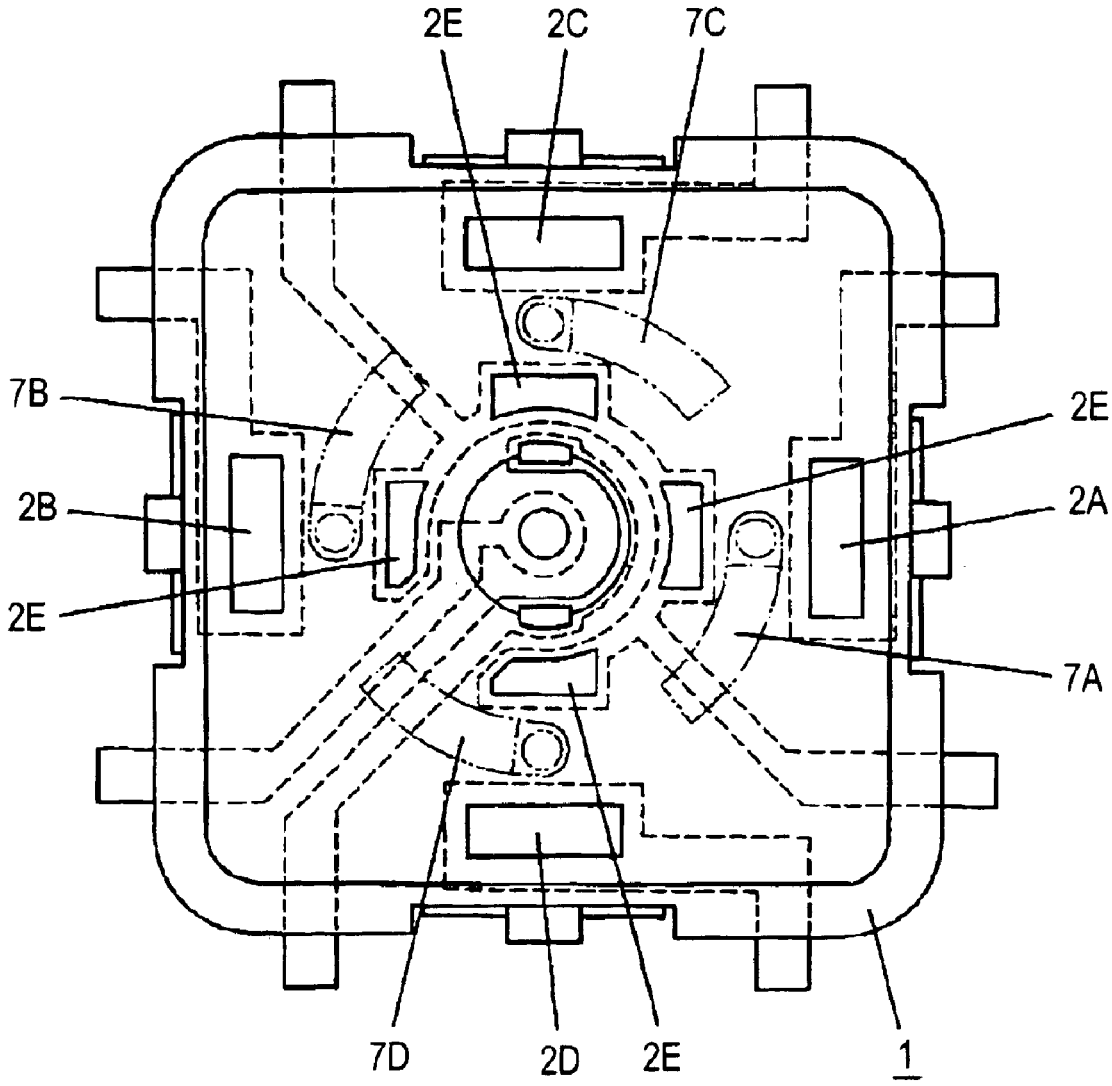
FIG. 12 PRIOR ART
FIG. 12 is a plan view of a case, an essential part of the multi-directional slide switch of FIG. 10.
Figure 13:
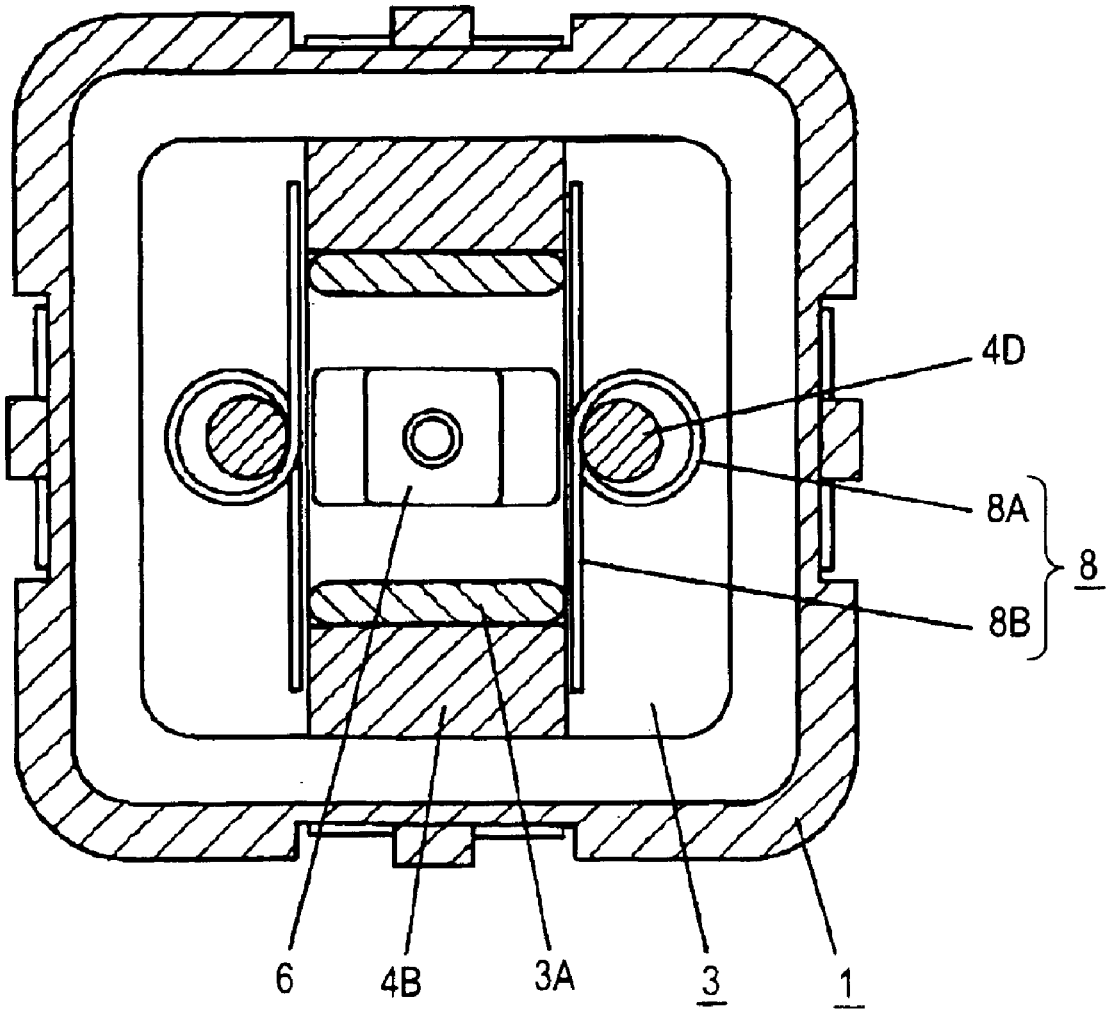
FIG. 13 PRIOR ART
FIG. 13 is a plan view of a section of the multi-directional slide switch of FIG. 10, illustrating how a first slide member thereof is assembled.
Figure 14:
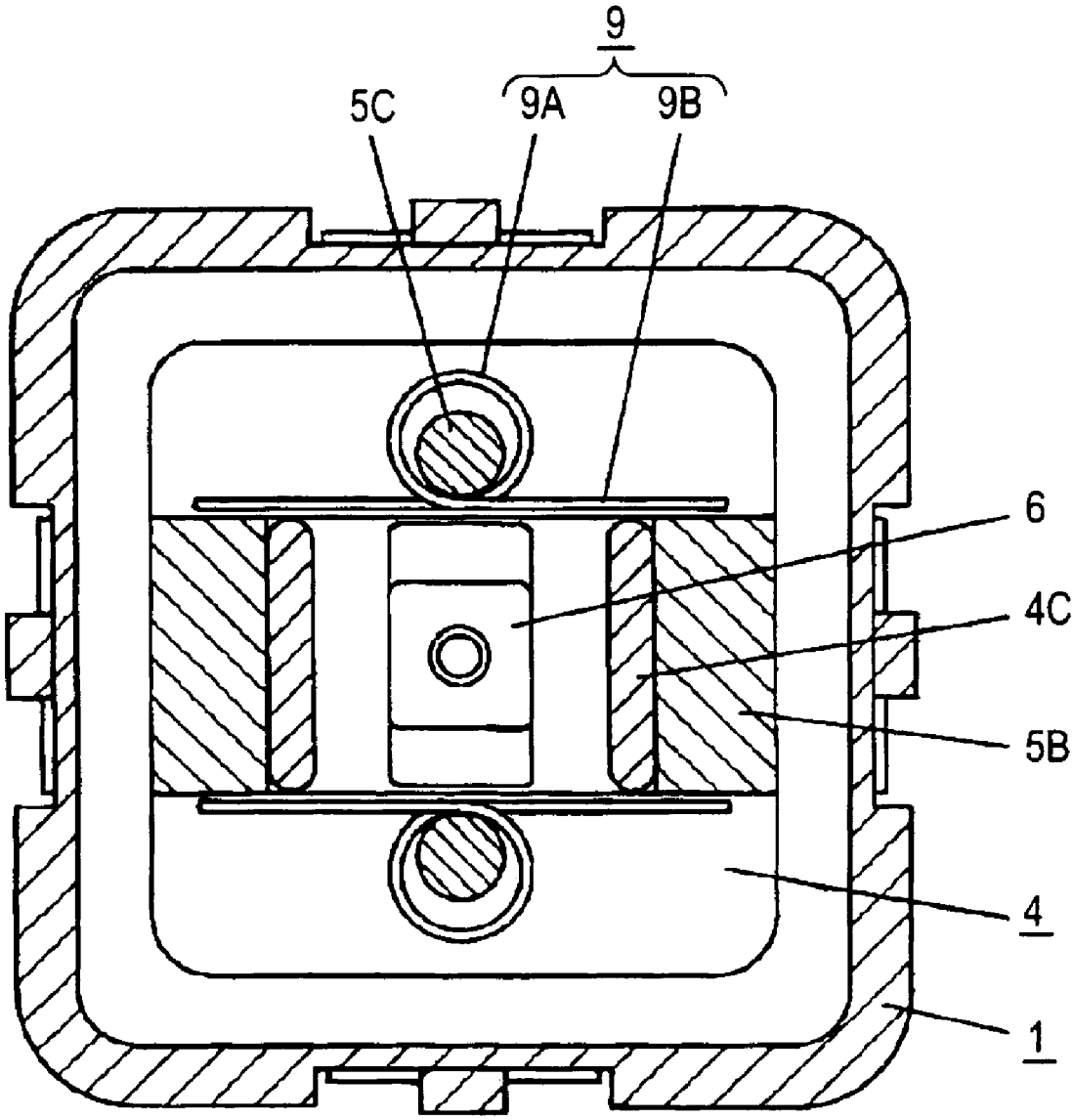
FIG. 14 PRIOR ART
FIG. 14 is a plan view of another section of the multi-directional slide switch of FIG. 10, illustrating how a second slide member thereof is assembled.
Figure 15:
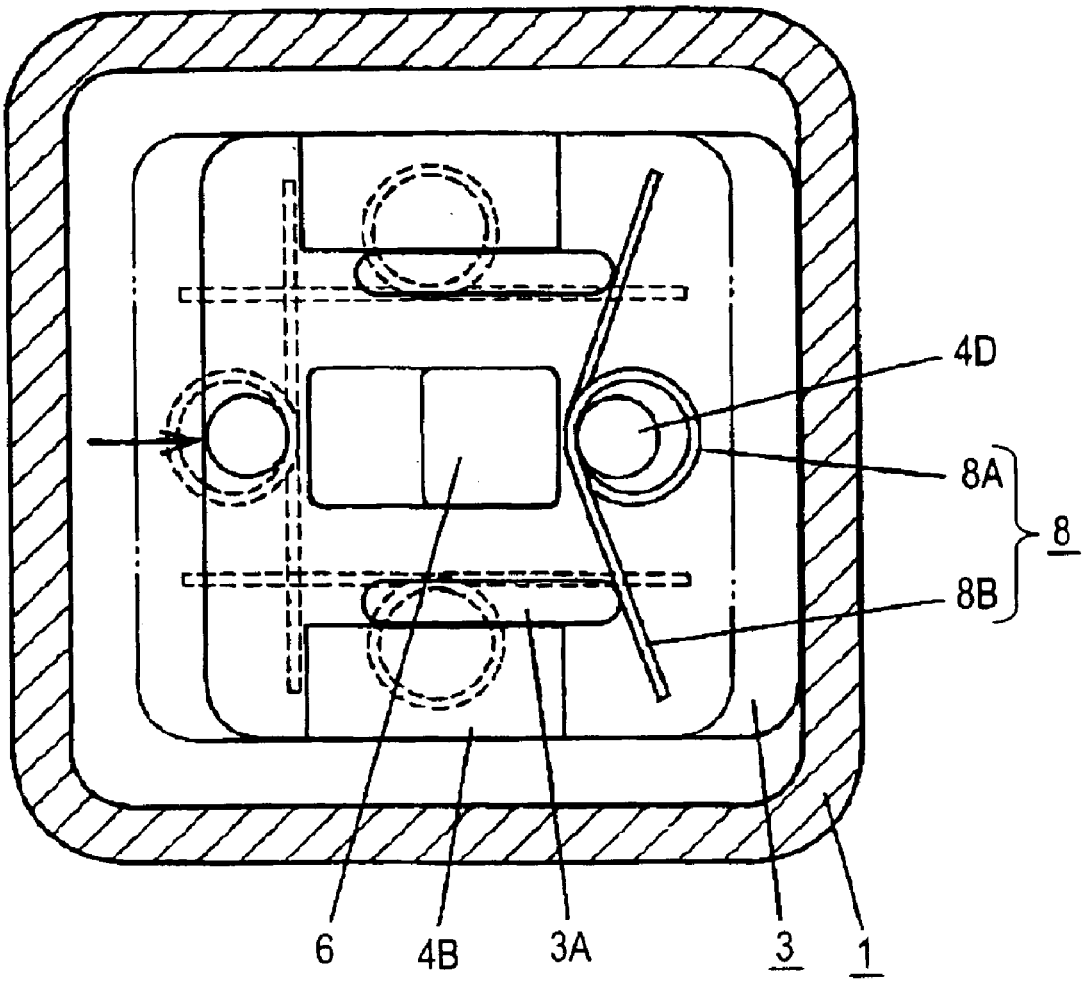
FIG. 15 PRIOR ART
FIG. 15 is a plan view of the multi-directional slide switch of FIG. 10, illustrating how a control lever thereof is slid in an X-axis direction.
Figure 16:
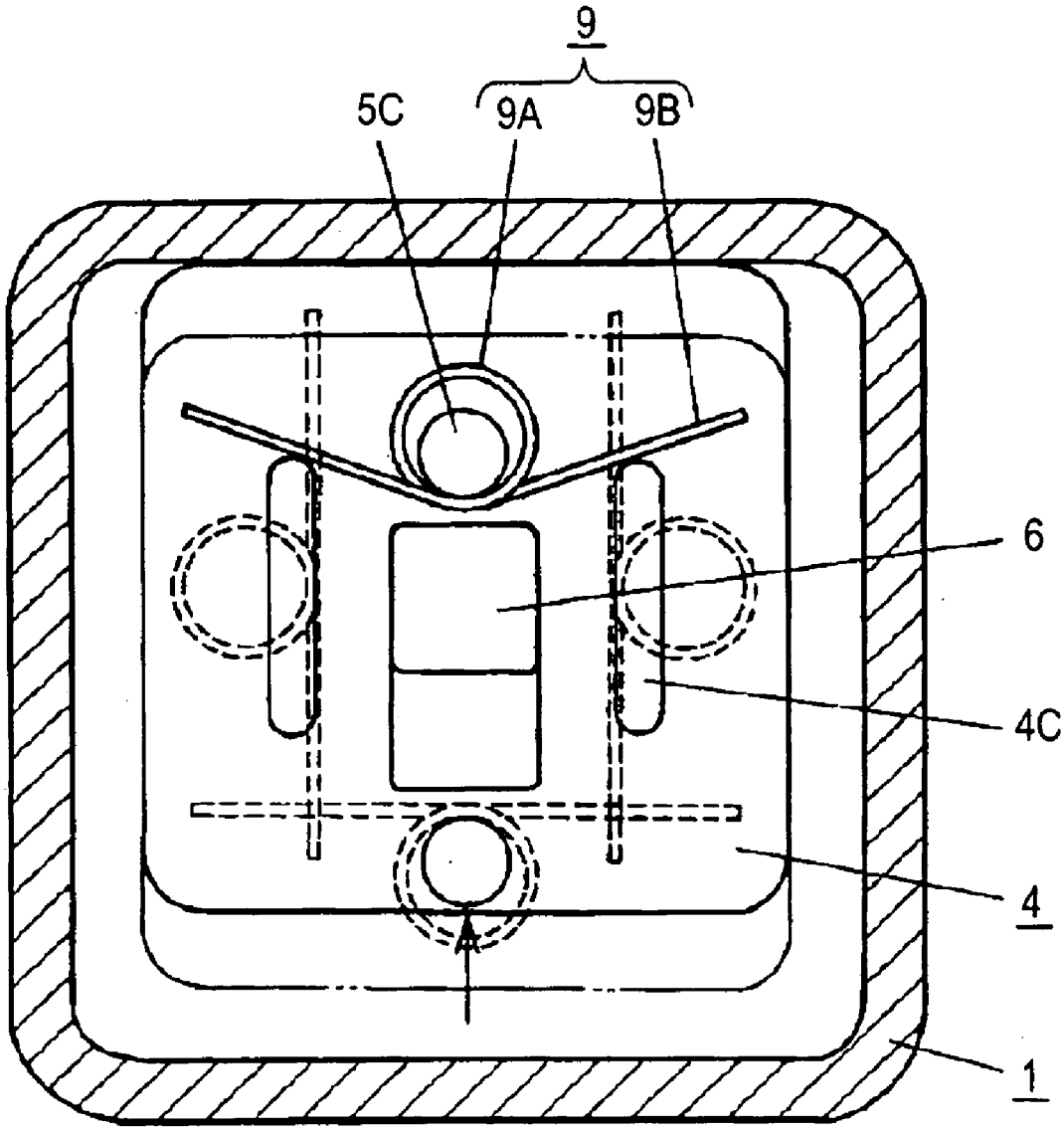
FIG. 16 PRIOR ART
FIG. 16 is a plan view of the multi-directional slide switch of FIG. 10, illustrating how the control lever thereof is slid in a Y-axis direction.

FIG. 9 is an elevational view in section of a multi-directional slide switch in accordance with a third exemplary embodiment of the present invention. In this embodiment, the structure of a driver is different from that of the first exemplary embodiment. The structure of the other components is the same as that of the first exemplary embodiment.

Control lever (hereinafter referred to as a "lever") 45 is engaged with center hole 44A through driver 44 to be independently and vertically movable. Bottom end projection 45A of lever 45 is in contact with the top surface of the top portion of dome-like movable contact 31 of the press switch section. Knob 46 covers the tip of lever 45. Between the bottom surface of knob 46 and cover 40, a clearance larger than the operative stroke of the press switch section is provided. In other words, lever 45 engages the body of driver 44 to be independently and vertically movable and also serves as a press rod.

Because of this structure, applying lateral force to slide knob 46 can actuates the slide switch section. Applying downward force to depress knob 46 can actuate the press switch section. Lever 45 and knob 46 have simple shapes as described above and the number of components can be reduced.

As described above, in the present invention, when a control lever is slid to move a driver housed in a case in a given direction, the movement of the driver causes the driver to push a given movable contact and slide and bring the movable contact into resilient contact with a corresponding fixed contact. This structure can provide a multi-directional slide switch of low profile that has a small number of constituent members and is easily assembled.

What is claimed is:

1. A multi-directional slide switch comprising:

a case comprising:

an inner bottom surface;

a sidewall standing erect from an outer periphery of said inner bottom surface; and a fixed contact provided on one of an inner surface of said sidewall and said inner bottom surface in a vicinity of said sidewall;

a movable contact disposed in said case so that one end of said movable contact can contact with said fixed contact, wherein movement of said movable contact toward a center of said case is restricted and said movable contact is slidable alone said sidewall; and a driver movably housed in said case, said driver being urged by said movable contact to be positioned in the center of said case in an inoperative state, wherein said driver is adapted to push said movable contact and bring said movable contact into contact with said fixed contact when said driver is slid.

2. The multi-directional slide switch of claim 1, wherein said driver comprises:

a control lever projecting away from said inner bottom surface; and a body portion having said control lever disposed thereon and movably housed in said case.

3. The multi-directional slide switch of claim 1, wherein said driver comprises a restricting portion, said case further comprises a guide part, and said guide part guides said restricting portion to restrict a direction when said driver is slid.

4. The multi-directional slide switch of claim 3, wherein said guide part further restricts movement of said driver to a predetermined amount.

5. The multi-directional slide switch of claim 1, wherein said movable contact is formed of a resilient thin metal plate and comprises:

a fixation portion fixed to a position on a line connecting a point on said inner bottom surface of said case and a corner of said inner bottom surface of said case;

a resilient leg having a root and a tip adapted to make contact with the inner surface of said sidewall contacting the corner of said inner bottom surface of said case; and a resilient arm connecting said fixation portion and the root of said resilient leg.

6. The multi-directional slide switch of claim 5, further comprising at least one additional movable contact similar to said movable contact, wherein a pair of said movable contacts are integrally formed into an M shape, and a corresponding pair of said resilient arms are supported in positions symmetrical with respect to the line connecting the point on said inner bottom surface of said case and the corner of said inner bottom surface of said case.

7. The multi-directional slide switch of claim 6, wherein said pair of movable contacts integrally formed into the M shape are disposed symmetrically with respect to the point on said bottom surface of said case.

8. The multi-directional slide switch of claim 5, wherein said driver comprises a contact portion in contact with a portion of said movable contact connecting said resilient arm and said resilient leg to keep said driver in the center of said case in the inoperative state.

9. The multi-directional slide switch of claim 8, wherein said contact portion pushes the portion of said movable contact connecting said resilient arm and said resilient leg of said movable contact in a direction in which said driver is moved, and thereby slides the tip of said resilient leg on the inner surface of said sidewall in contact with the tip and brings said movable contact into contact with said fixed contact.

10. The multi-directional slide switch of claim 1, further comprising:

a press switch section in a center of said inner bottom surface of said case; and a press rod passing through said driver, said press rod disposed to be vertically movable.

11. The multi-directional slide switch of claim 10, further comprising:

a cover for covering a top opening of said case;

a control lever projecting from a hole provided in a center of said cover, said control lever adapted to slide said driver; and a knob attached to said control lever, wherein an outer peripheral bottom end of said knob is in contact with an outer periphery of the hole through said cover, and said press rod is adapted to be depressed through a through-hole provided in a center of said knob.

12. The multi-directional slide switch of claim 10, further comprising a control lever for sliding said driver, said control lever engaging said driver to be independently and vertically movable and also serving as said press rod.

13. The multi-directional slide switch of claim 10, wherein said case further comprises a wall surrounding said press switch section at a center of said inner bottom surface, said press rod is positioned above a top end of said wall by a predetermined amount while in an inoperative state, said press rod has a flange at a bottom end thereof, and a clearance between the flange and an inner circumference of said wall is smaller than an amount of movement of said driver in a sliding operation.

* * * * *

UNITED STATES PATENT AND TRADEMARK OFFICE

CERTIFICATE OF CORRECTION

PATENT NO. : 6,906,269 B2
APPLICATION NO. : 10/693964
DATED : June 14, 2005
INVENTOR(S) : Kenji Nishimura et al.

It is certified that error appears in the above-identified patent and that said Letters Patent is hereby corrected as shown below:

IN THE CLAIMS

Column 10, line 10, please replace "slidable alone said" with --slidable along said--

Signed and Sealed this

Twentieth Day of February, 2007

JON W. DUDAS
*Director of the United States Patent and Trademark Office*